US007353606B2

(12) United States Patent
Hudgins

(10) Patent No.: US 7,353,606 B2
(45) Date of Patent: Apr. 8, 2008

(54) HAIR CUTTING AND STYLING RAZOR

(76) Inventor: Cari Ann Hudgins, 149 Oak Glen, Escondido, CA (US) 92025

( * ) Notice: Subject to any disclaimer, the term of this patent is extended or adjusted under 35 U.S.C. 154(b) by 206 days.

(21) Appl. No.: 11/193,072

(22) Filed: Jul. 28, 2005

(65) Prior Publication Data

US 2007/0022604 A1 Feb. 1, 2007

(51) Int. Cl.
*B26B 21/12* (2006.01)
*B26B 21/56* (2006.01)

(52) U.S. Cl. ..... 30/30; 30/53; 30/346.55; 30/346.57

(58) Field of Classification Search ..... 30/51, 30/53, 54, 55, 346.5, 346.55, 346.56, 353, 30/355, 356, 357, 47, 48, 49, 30
See application file for complete search history.

(56) References Cited

U.S. PATENT DOCUMENTS 1,266,672 A * 5/1918 Forster ..... 30/165
1,336,696 A * 4/1920 Barney ..... 30/53
2,043,998 A 6/1936 Hadjopoulos
2,108,267 A * 2/1938 O'Neill ..... 30/346.58
2,674,039 A 4/1954 Mesquita
4,021,912 A * 5/1977 Stanfield ..... 30/280
4,457,070 A * 7/1984 Reeves ..... 30/314
4,603,477 A 8/1986 Francis
4,858,323 A 8/1989 Iten
6,311,397 B1 11/2001 Hartzell et al.
6,367,533 B1 4/2002 Pitzen
6,505,403 B1 1/2003 Andrews
6,519,856 B1 2/2003 Dischler

* cited by examiner

*Primary Examiner*—Hwei-Siu C. Payer
(74) *Attorney, Agent, or Firm*—Donn K. Harms

(57) ABSTRACT

A razor cutter for hair using a blade having one or two accordion shaped cutting edges to allow a feathered cut of hair strands at different points when the cutting edge of the blade contacts hair. Each cutting edge is made up of a plurality of smaller edge sections in angled engagement. The cutting edges may also be angled diagonally to yield a cutting edge that is both accordion shaped, and has individual cutting edges which alternately angle toward and away from the center of the blade.

10 Claims, 3 Drawing Sheets

HAIR CUTTING AND STYLING RAZOR

FIELD OF THE INVENTION

The disclosed device relates to hair cutting. More particularly, the device relates to implements for the cutting, thinning and styling of hair on the top of the head and specifically to a device utilizing one or more arched, dihedrally corrugated double-edged blades with opposed "zig-zag" xyresic cutting surfaces on opposing contact edges.

BACKGROUND OF THE INVENTION

The cutting, trimming, general maintenance and styling of hair, specifically that found upon the head, has been a common practice reaching back to prehistoric times. A myriad designs have evolved for this purpose, most of which embody single or double-sided, straight-edged cutting surfaces. Such cutters include shears, razor blades, so-called safety razors, scissors and knives and other devices.

In conventional razor cutters for hair styling the uniform straight contact edge of the cutting surface causes a pulling and tugging of the hair as the cutting surface on the contact edge of the blade enters the hair strands prior to actual severance of the strand. The resulting cut is generally in a straight line which follows the contact surface shape and results in a hair shear plane substantially in a straight line.

Only with great difficulty and the skill of the user can a non-straight shear plane be created which must be carefully feathered or blended into the previous cut using a straight-edged razor cutter. This increases the skill level requirement of the operator and the number of bad haircuts that occur while the operator obtains that skill.

Similarly, the thinning or reduction of the bulk of the hair-mass on the head during hairstyling with a straight-edged razor is also quite difficult and more likely to cause injuries when working around the ears. Prior art is replete with numerous examples of single-edged, double-edged, opposed blades and other mechanisms, the majority of which provide blade cutting of hair for the purpose of the shaving of the face.

DESCRIPTION OF PRIOR ART

U.S. Pat. No. 2,043,998 (D. B. Hadjopoulos) portrays an invention of a safety razor and blade for the purpose of improving the means of oblique or angular cutting or shaving action upon facial hair as distinguished from that which results from a blade of the straight-edged design. This approach requires a safety razor holder, the implementation of which does not easily lend itself to the controlled cutting of non-facial hair. The device of Hadjopoulos has a handle that will block the view of the user and uses flat blades which contact hair being cut in-line on the plane. It is thus hard to use visually and will not allow for easy feathering and bulk reduction on a head of hair.

U.S. Pat. No. 2,674,039 (Mesquita) elaborates a design, the primary goal of which is to reduce the cost of the materials and manufacturing labor used to produce a straight-edged safety razor shaving blade. Though these goals are achieved as outlined, Mesquita simply provides a conventional straight edge cutting surface in one plane.

U.S. Pat. No. 4,858,323 (Iten) depicts a proposal for an integrally backed single-edged razor blade intended to simplify the manufacture and use of such single edged blades. This example does reduce costs associated with manufacture, but actual use of the resulting blade does not satisfy the goals of easily blending the shear line of the cut hair, a shortfall of all noted straight edged blades.

U.S. Pat. No. 6,505,403 (Andrews) expresses a description of a device for hair shaving using a U-shaped razor blade strip. The mechanism is a manually operated, finger-manipulatable non-electric hair trimming device for shaving nostril hair, ear hair or the like, includes a head structure sized to fit within a small body cavity, such as a person's nostril or ear cavity, which includes a flexible razor blade strip. The head structure further has a thin, elongated narrow razor blade strip with a razor sharp first edge portion which may be a serrated edge with razor-sharp notches such as V-slots or may be a conventional straight edge. Alternatively, two razor-sharp edges, one serrated and one straight, may be provided. The proposal for and primary implementation envisioned for this apparatus is the trimming of hair found in internal orifices such as the nose, ears or other cavities in which hair is to be found and does not provide for the styling, cutting and maintenance of external hair such as that found generally on the top and sides of the head.

U.S. Pat. No. 6,519,856 (Dischler) is for a safety razor head with intrinsic fencing and lateral skin tensioning nodes and is specifically directed to safety razor heads having intrinsically fenced cutting blades oriented at a high slicing angle to the shaving direction. The intent here is to enhance cutting action, improve lubricant and debris flow, and prolong the life of the cutting edges. Lateral skin tensioning is achieved in one embodiment by the spreading action of left and right oriented cutting edges. Again, this device is for the control of facial hair with the blades sliding on the skin and is not conducive to razor style haircuts.

It has been seen that there is a need in the tonsorial profession for a razor cutter device for haircuts that is simple to use, especially for the less expert operator. Such a device should increase operator and client safety while concurrently facilitating feathering and other requirements of razor style haircuts. Such a device should also provide improved results in the areas of thinning, blending and maintenance of the hair by razor cutting. Still further, such a device should be easily held in the hand and employ a blade holder which allows for the contact or cutting edge of the blade to be viewed as it slices hair strands during use to facilitate accurate cutting by the user.

Therefore, one object of this invention is to provide a less defined and more blended resultant haircut shear plane than a comparable straight-edged device such as a safety razor when used in place of a straight-edged tool.

An additional object of this invention is to provide the improved capability of thinning out or reducing overall bulk of the hair mass.

Another object of the present invention is to provide an improved capability for texturizing of the hair as a result of the curved, zig-zag hair cutting plane resulting from the shape of the blade and the operator managed depth and cutting angle of the engaged hair surface.

A still further object of the invention is to provide increased safety for both the operator and client during the above noted processes.

SUMMARY OF THE INVENTION

The disclosed hair styling razor and blade, through the use of a unique corrugated or accordion shaped contact edge having cutting edges in a v-shaped or zig-zag shape provides a means to sever hair strands at different points on the shear plane of each cut. Such a cutting action generates an easily blended result far improved from conventional blades which cut hair strands in-line on the cutting plane.

Additionally, when cutting the hair strands using the points or tips of the v-shaped cutting edge as opposed to the full surface, the hair can be thinned out or de-bulked without using thinning shears, thereby saving the operator time and the need to shift cutting instruments. Safety and economy is enhanced by the reduced number of tools required and by the reduced interaction with the hair that would otherwise be required with the use of a straight-edged blade as is now the standard.

With respect to the above description, before explaining at least one preferred embodiment of the invention in detail, it is to be understood that the invention is not limited in its application to the details of construction and to the arrangement of the components or steps set forth in the following description or illustrated in the drawings. The apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other apparatuses, methods and systems for carrying out the several purposes of the present disclosed device. It is important, therefore, that the objects and claims be regarded as including such equivalent construction and methodology insofar as they do not depart from the spirit and scope of the present invention.

Further objectives of this invention will be brought out in the following part of the specification, wherein detailed description is for the purpose of fully disclosing the invention without placing limitations thereon.

BRIEF DESCRIPTION OF THE ASSOCIATED DRAWINGS

FIG. 1 displays a perspective view of the device engaged with a handle end and a undulating blade engagement end.

FIG. 2 depicts a side view of the device in FIG. 1 showing the blade engaged between top and bottom engagement walls of a blade case.

FIG. 3 displays a side view of another preferred mode of the device showing a top view of a planar blade case engagement end with an internal mounted blade having a cutting edge formed of a plurality of angled segments.

Figure 5:
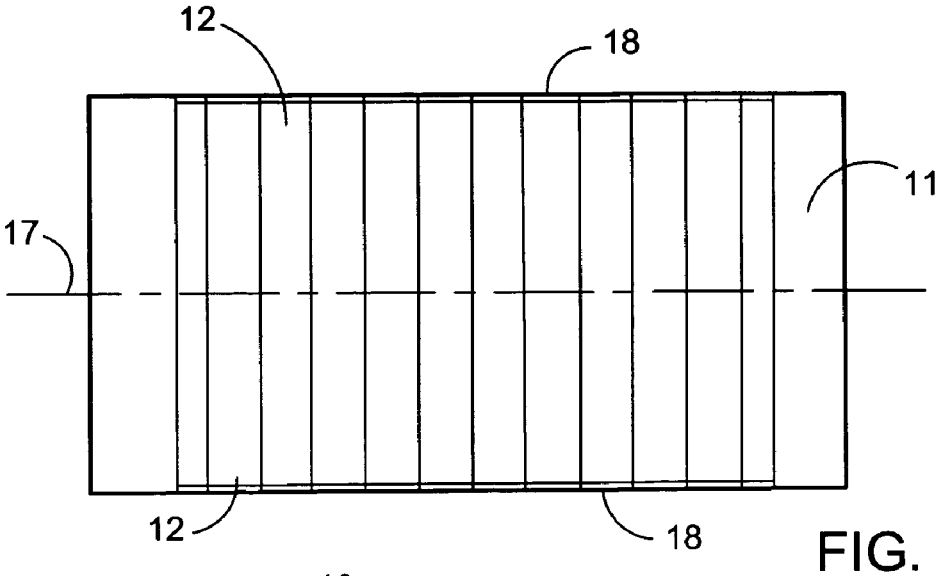
FIG. 5 shows a top plan view of an undulating blade cutting surface having a substantially straight cutting edge.
Figure 5A:
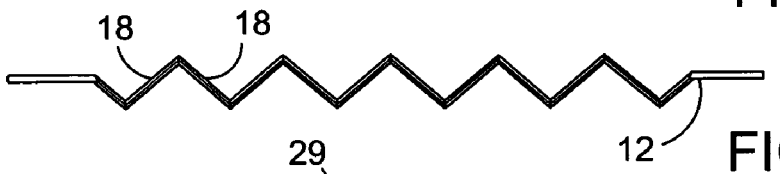

FIG. 5*a* depicts a top view of FIG. 5 showing the undulating cutting surface typical of blades used with all embodiments of the device.

Figures 1, 2:
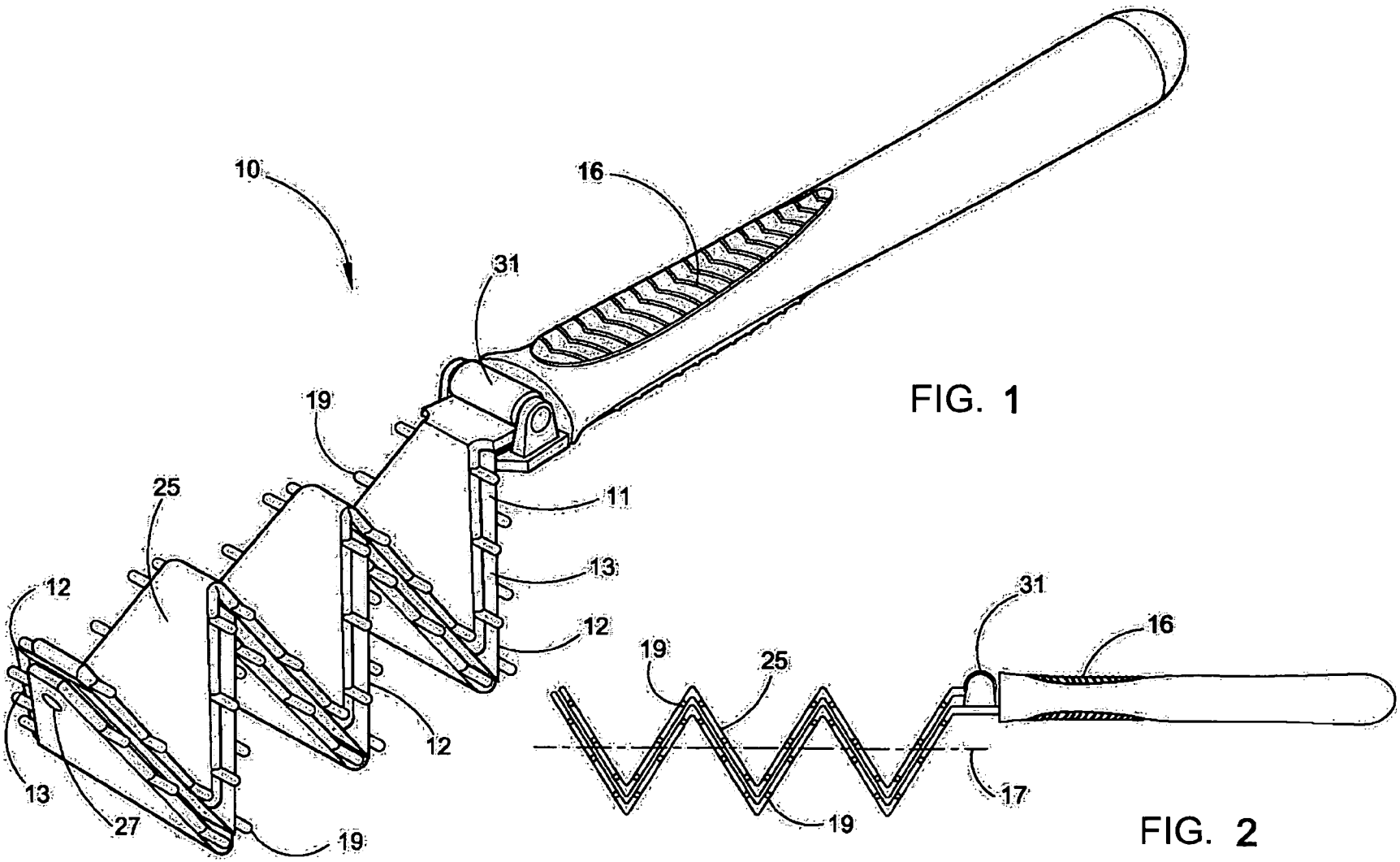
Figure 3:
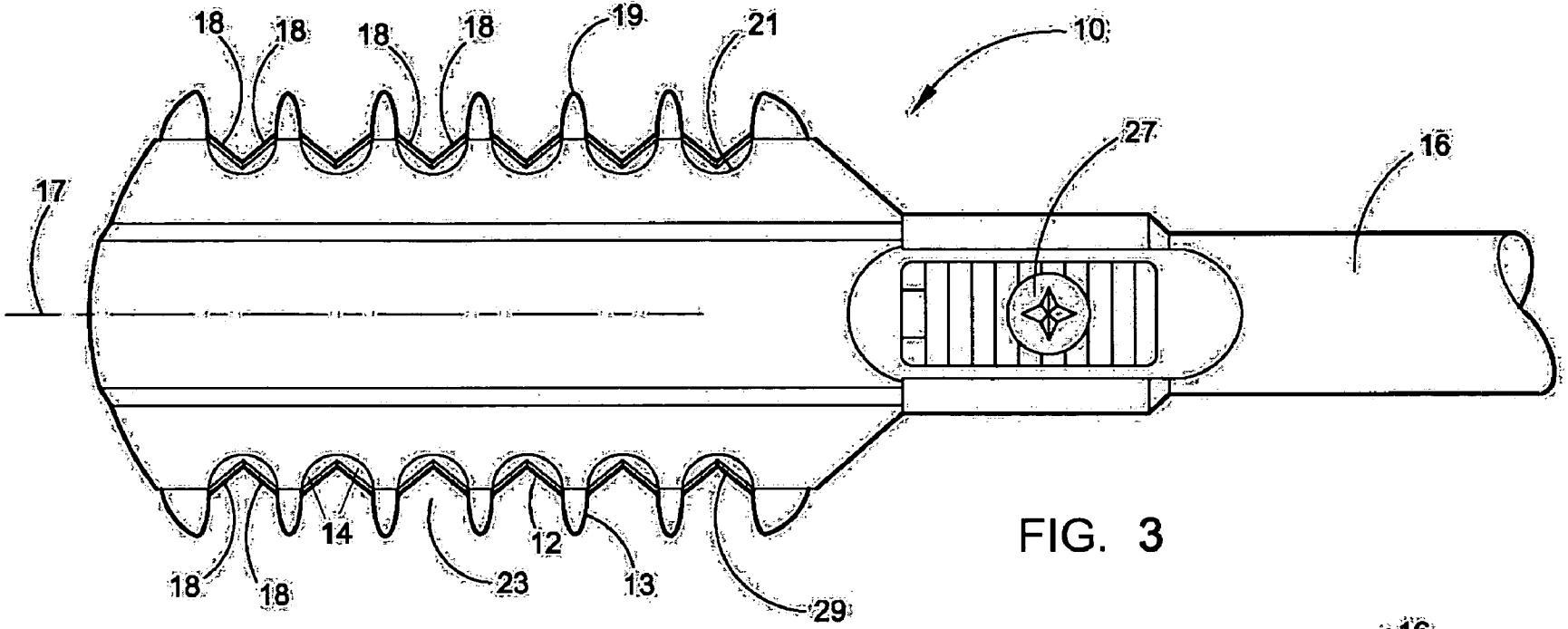
Figure 4:
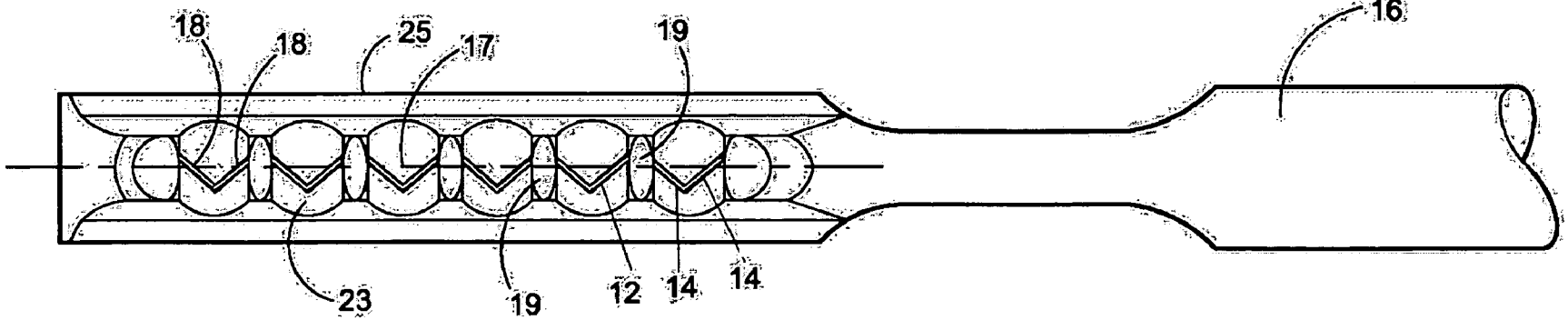
FIG. 4 depicts a side view of a mode of the device in FIG. 3 showing the blade engaged in the planar blade case attached to a side projecting handle and having an undulating cutting edge formed by a plurality of angled segments.
Figure 6:
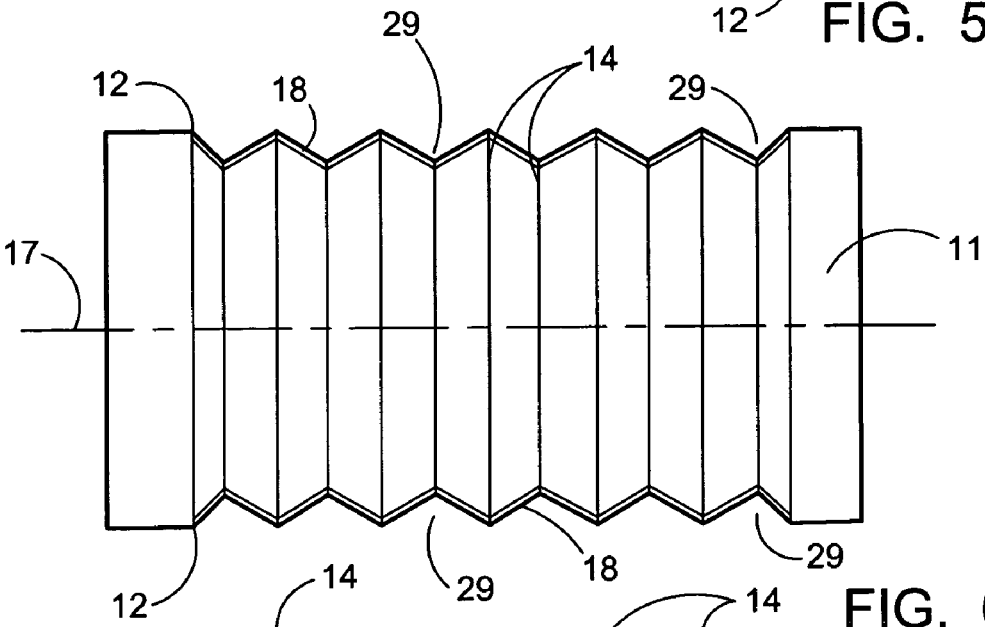

FIG. 6 depicts a top view of an undulating blade cutting surface with recesses formed between the leading edge of the blade between folds as depicted in FIGS. 1 and 3.

Figure 6A:
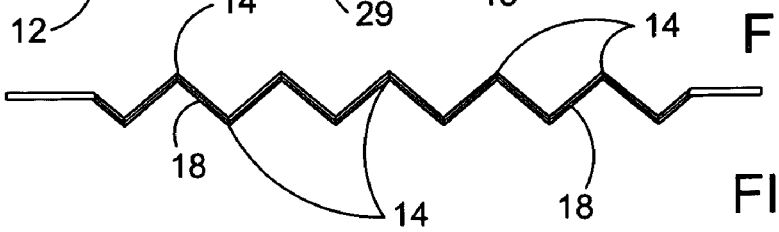

FIG. 6*a* depicts a side view of FIG. 6 showing the undulating cutting edge and receding cutting surfaces.

Figure 7:
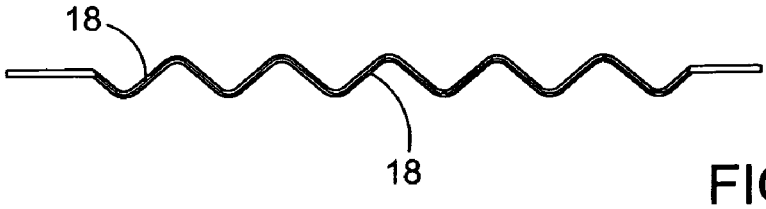

FIG. 7 shows a side view another embodiment of the device wherein the cutting edges are curved as opposed to saw-toothed or linear.

DETAILED DESCRIPTION OF PREFERRED EMBODIMENTS OF THE DISCLOSED DEVICE

Referring now to the drawings FIGS. 1-7 disclose the details of the preferred embodiments of the disclosed device 10 herein. The advantages of the invention as here outlined are best realized when all of the features and instrumentalities are combined in one component. However, a highly useful and improved razor hair cutting device can be produced embodying less than the whole and such is anticipated in the scope of this application.

Referring in detail to the drawings, the device 10 employs a blade 11 having at least one contact edge 12 and preferably two opposite facing contact edges 12 formed of edge sections 13 that undulate or accordion traversing across a plane extending out from said center axis 17 and/or angle toward and away from the center axis 17 of the blade 11. The center axis 17 of the blade can be inline with the handle axis or might be offset from the handle axis and might be engaged at an angle to the handle axis. However, currently a preferred mode substantially aligns the blade center axis 17 with the handle 16 extending from a side edge of the blade 11 or blade case 25.

The device includes the metal blade 11 of a desired size for the job at hand which is generally of a uniform thickness throughout. The blade 11 is engaged to a handle 16 adapted to hold it using either permanent or removable means for cooperative engagement of the blade 11 to the handle 16.

The leading edge or contact edge 12 surfaces of the blade 11 along each edge section 13 which encounters and cuts the hair, are characterized in that they demonstrate a plurality of undulating edges which form a plurality of diagonal cutting surfaces 18 on the two opposite facing contact edges 12 of the blade 11. Placing the contact edges 12 on both outside edges of the blade 11 allows the user to pull or push the cutting edges 18 formed thereon, through the hair being trimmed or thinned in a razor cut type of haircut or to use one edge until dull and rotate to use the other. Also, the length of the individual cutting surfaces 18 on each opposing contact edge 12 may be different on different blades 11 engaged to the handle 16 if desired, to thereby obtain a different cutting characteristics on both opposing contact edges 12.

The length of the individual cutting surfaces 18 is determined by the length of the edge sections 13 between the bends in the blade 11. Varying the individual cutting surfaces 18 length is accomplished by bending the blade 11 during manufacture to yield the folds at the proper position to provide edge sections 13 of the appropriate length for cutting surfaces 18 of the desired length. As shown in FIG. 1 there are six edge sections 13 yielding six angled cutting surfaces 18 while FIG. 3 depicts twelve shorter edge sections 13 yielding twelve somewhat shorter cutting surfaces 18.

It is the length of these individual cutting edges 18 which determine the shape of the contact edge 12 and the distance the edges 18 extend out of plane from the blade center axis 17 running through the blade 11 from the distal end of an attached handle 16 if it is so engaged with longer cutting edges 18 extending further. The actual length of the cutting surfaces 18 would be that which is desired to yield the proper razor cut of the hair. This would be most useful when cutting hair to have the ability to cut different shaped edges. As is obvious to those skilled in the art, the means for engaging the blade 11 to the handle 16 herein depicted as a blade case 25 would be adapted to accommodate the shape of the blade 11 used and the number of folds 14 in the blade 11 which yield the desired number and length of the cutting surfaces 18 at the leading edge of the blade 11. This assumes that a safety blade style razor is being constructed since in a more spartan mode of the device 10, the blade 11 could be simply attached to a handle 16 with no blade case 25. Of course other means to engage the blade 11 to the handle 16 may be employed by those skilled in the art, and all such are anticipated.

The contact edge 12 of the blade 11 has a plurality of individual sections formed by the opposing diagonal cutting edges 18 which extend contiguously from the beginning edge and terminating edge of the blade 11. The cutting edges 18 extend from the blade case 25, removably or permanently housing the blade 11, a sufficient distance to cut hair strands. As noted, blade surface adjacent to the contact edges 12 translates out of the plane away from and toward the blade center axis 17 by employing a plurality of accordion-like pleats or folds 14 in the blade 11 along the contact edge 12. This provides a plurality of cutting edges 18 which follow the same accordion shape of the blade 11 the length of which are defined by the placement of individual folds 14 and the angle of the intersection of the cutting surfaces 18 at the folds 14. Of course the contact edge 12 with modern metal manufacturing might be accordion shaped with the rest of the interior of the blade 11 being planar; however, currently bending the entire blade 11 long folds 14 is a less expensive manner to manufacture the blades 11 with an accordion type contact edge 12.

If the contact edge 12 is substantially straight and the cutting surfaces 18 do not angle at the folds 14 as in FIG. 5, the result is a plurality of cutting edges 18 which will contact the hair strands at substantially the same time when used to cut hair.

However, an alternate mode of the device 10 employs not only an undulating contact edge 12 but also individual cutting edges 18 that angle toward and away from the axis 17. If the series of folds 14 is employed to shape the contact edges 12 and the cutting edges 18 also angle at the folds 14 toward and away from the center axis 17 at each fold, it will result in a fluted or beveled shear plane of the contact edge 12. When this mode of the contact edge 12 is employed to cut hair strands as shown in FIG. 6, recesses 29 formed in the contact edges 12 between every two folds 14 allow contact with the hair at different times or positions. The resulting contact with the hair across the length of the contact edges 12 will occur earlier for the points on the contact edge 12 furthest from the center axis and consecutively later for the points on the contact edge as they slant inward toward the center of the blade 11. Such a cutting action is more of a slicing action and will generally cut through the hair easier. In a particularly useful mode of the device 10 one of the contact edges 12 on one side of the blade can employ a straight surface as in FIG. 3 and the other can have a recessed edge as in FIG. 4. The blade case 25 would of course be adapted for operative mounting of such a configured blade 11. This would allow the user to cut the hair differently by simply rotating the device 10 to either the substantially straight shaped contact edge 12 or the recessed contact edge 12 shown in FIG. 4.

In all embodiments, a handle 16 extending from a blade case 25 adapted to operatively hold or engage with the blade 11 is employed. A blade case 25 or other means to attach the blade to the handle would be adapted to hold the blade 11 with the cutting edges 18 forming one or both contact edges 12 on opposing sides in position to cut hair strands. The user would thus grip the handle 16 engaged with the blade 11 of choice for the haircut intended and cut the hair by pushing or pulling the contact edge 12 through the hair at the appropriate point on the strands. In an inexpensive throw-away embodiment of the device 10 the blade might be permanently mounted in the blade case 25 or other means to hold the blade and engage it with the handle 16. Once used, the engaged blade 11 and handle 16 could be thrown away. In more expensive models of the device 10 a blade case 25 would be adapted for removable engagement of the blade 11 therein.

As depicted in FIG. 1, one mode of the blade case 25 would have two halves shaped to accommodate the folds of the blade 11 and the slants of the cutting edge 12 between the folds 14. A means engagement of one half of the case with the other would be provided by a hinge 31 and the two halves are joined by a screw 27. Of course numerous configurations of a blade case 25 are employable as a means to engage the blade 11 operatively to the handle 16 and all are anticipated.

For example, in FIG. 3 the two halves of the blade case 25 are more planar but still accommodate the folds 14 at their peaks forming the individual cutting sections 18 of the encased blade 11. A screw 27 would allow separation of the two halves forming the blade case 25 for easy installation. It is envisioned that an inexpensive mode of the device might eliminate the blade case 25 and related safety it provides to the user from injury if desired; however, a preferred mode of the device 10 would provide a blade case 25 adapted to operatively engage the blade 11. The handle 16 should be formed having a circumference easily held by the fingers of the user.

Also provided in a preferred mode of the device 10 extending from the blade case 25 are a plurality of safety extensions 19 slightly longer than the point of intersection of each two adjacent cutting edges 18 furthest from the axis 17. The gap 23 between each safety extension 19 communicating with the open end of the cutting cavity 21 would be small enough to preclude the passage of a finger or body part and thereby provide a means to protect the user from accidental cuts to the fingers and hands by the cutting edges 18. This would also protect the customer when the device 10 is used to trim hair close the skin of the head or neck.

The handle 16 works best if it extends from one of the side edges of the blade 11 in line with or substantially parallel to the center axis 17 if the handle 16 is substantially parallel with the center axis of the blade 11 housed in the blade case 25 between the two opposing contact edges 12. The handle 16 may engage the blade 11 so that its center axis runs adjacent to the peaks of the undulating blade 11 has shown in FIGS. 1 and 2 or could run through the folds and in line with the axis 17 of the blade 11 or it might be in an angled engagement with the side edge of the blade 11 depending on the use and user preference. A side projection from the blade 11 is highly desirable to place the handle 16 out of the way of one or both cutting edges 18. This allows the user to concurrently grip the handle 16 and still provides a unobstructed view the cutting edges 18 from either below the blade or above the top surface of the blade as the cutting edges 18 encounter the hair strands on the head of the customer and make very accurate cuts. While a handle engagement with a handle axis normal to the blade axis 17 might be used, it would be harder for the user to employ the blade and see what they are doing. However, it is anticipated that other angles and points of engagement of the handle 16 with the blade 11 may be employed by those skilled in the art, and consequently, any engagement of the handle 16 to the blade 11 that allows the device to be employed to cut hair is anticipated. Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described may be employed in accordance with the spirit of this invention. Any and all such changes, alternations and modifications, as would occur to those skilled in the art, are considered to be within the scope of this invention as broadly defined in the appended claims.

Further, the purpose of the attached abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. A razor cutter for hair, comprising:

a blade, said blade having two side edges and two end sections communicating between said two side edges;

said blade having a top surface and a bottom surface;

said blade having a center axis running therethrough;

said blade having a first cutting edge running upon a first one of said side edges;

said first cutting edge defined by a plurality of individual edge sections, each said end section intersecting at least one adjoining said edge section at an angle;

said individual edge sections alternately traversing a horizontal plane extending from said center axis;

a blade therein and substantially conforming to the shape of said blade with said first cutting edge protruding outwardly and exposed for use engagement case housing said blade; and a handle extending from said blade engagement case, and whereby said blade extends from said handle and said first cutting edge is substantially accordion in shape.

2. The razor cutter of claim 1 also having:

said blade having a second cutting edge, said second cutting edge running upon a second one of said two side edges;

said second cutting edge also defined by a plurality of said individual edge sections, each said end section intersecting at least one adjoining end section at an angle; and said individual edge sections of said second cutting edge alternately traversing a horizontal plane extending from said center axis, whereby both said first cutting edge and said second cutting edge have an accordion shape.

3. The razor cutter of claim 2 also having:

said handle extending from a side of said blade at one of said end sections and adapted for gripping by the hand of a user;

a leading edge defined by either of said first cutting edge or said second cutting edge employed by said user to cut hair strands during a haircut procedure;

a substantially unobstructed viewing area adjacent to said leading edge during said haircut procedure when said razor is held by said handle and viewed by said user from above said top surface; and said substantially unobstructed viewing area adjacent to said leading edge also viewable by said user from below said bottom surface during said haircut procedure.

4. The razor cutter of claim 3 also having:

said edge sections defining said first cutting edge alternately angling toward and away from said center axis; and whereby adjacent hair strands of said hair cut by said first cutting edge will be severed at slightly different lengths by said edge sections.

5. The razor cutter of claim 2 also having:

said edge sections defining said first cutting edge alternately angling toward and away from said center axis; and whereby adjacent hair strands of said hair cut by said first cutting edge will be severed at slightly different lengths by said edge sections.

6. The razor cutter of claim 2 also having:

said edge sections defining said first cutting edge alternately angling toward and away from said center axis;

said edge sections defining said second cutting edge alternately angling toward and away from said center axis; and whereby adjacent hair strands of said hair cut by either said first cutting edge, or said second cutting edge, will be severed at different lengths by said edge sections.

7. The razor cutter of claim 1 also having:

said handle extending from a side of said blade at one of said end sections and adapted for gripping by the hand of a user;

a substantially unobstructed viewing area adjacent to said first cutting edge and hair being cut by said first cutting edge when said razor is held by said handle and viewed by said user from above said top surface; and said substantially unobstructed viewing area adjacent to said first cutting edge and hair being cut also viewable by said user from below said bottom surface.

8. The razor cutter of claim 7 also having:

said edge sections defining said first cutting edge alternately angling toward and away from said center axis; and whereby adjacent hair strands of said hair cut by said first cutting edge will be cut at different lengths by said edge sections.

9. The razor cutter of claim 1 also having:

said edge sections defining said first cutting edge alternately angling toward and away from said center axis; and whereby adjacent hair strands of said hair cut by said first cutting edge will be cut at different lengths by said edge sections.

10. The razor cutter of claim 1 wherein said blade is adapted for removable mounting within said engagement case, thereby rendering said blade replaceable.

* * * * *